US007083326B2

(12) United States Patent
Ast et al.

(10) Patent No.: US 7,083,326 B2
(45) Date of Patent: Aug. 1, 2006

(54) ADJUSTABLE WATCH CRYSTAL APPARATUS

(76) Inventors: Ryan C. Ast, 1701 W. 4th, Apt. B, Lawrence, KS (US) 66044; Janet S. Ast, 4427 Spyglass Cir., Wichita, KS (US) 67226

( * ) Notice: Subject to any disclaimer, the term of this patent is extended or adjusted under 35 U.S.C. 154(b) by 0 days.

(21) Appl. No.: 10/939,907

(22) Filed: Sep. 13, 2004

(65) Prior Publication Data

US 2006/0062090 A1 Mar. 23, 2006

(51) Int. Cl.
*G04B 39/00* (2006.01)

(52) U.S. Cl. ..... 368/296; 368/223

(58) Field of Classification Search ..... 368/84, 368/88, 223, 242, 294, 296
See application file for complete search history.

(56) References Cited

U.S. PATENT DOCUMENTS

| | | | |
|---|---|---|---|
| 4,043,116 | A | 8/1977 | Schlappi |
| 4,451,117 | A | 5/1984 | Goode |
| 4,584,799 | A | 4/1986 | Juvet |
| 5,566,137 | A | 10/1996 | Chevroulet et al. |
| 5,574,701 | A | 11/1996 | Harilela |
| 5,883,860 | A | 3/1999 | McKay |
| 6,275,333 | B1 | 8/2001 | Shaffer |
| 6,307,686 | B1 | 10/2001 | Ferraro |
| 6,406,769 | B1 | 6/2002 | Delabre |

FOREIGN PATENT DOCUMENTS

| | | | |
|---|---|---|---|
| JP | 10268790 | A * | 10/1998 |
| JP | 2004085513 | A * | 3/2004 |

* cited by examiner

*Primary Examiner*—Kammie Cuneo
*Assistant Examiner*—Jeanne-Marguerite Goodwin
(74) *Attorney, Agent, or Firm*—Dale J. Ream

(57) ABSTRACT

An adjustable watch crystal apparatus includes a watch body, a flexible lens having a changeable amount of curvature, and means for adjusting the amount of curvature of the flexible lens. The flexible lens is positioned upwardly adjacent a watch face for adjustably refracting light to make the watch face legible for a user with farsighted vision. The flexible lens includes top and bottom sides having convex configurations, an outer edge, and a center. The adjusting means includes a collar member attached to the watch body for retaining the flexible lens outer edge. In one embodiment, an adjustment screw controls the curvature of the flexible lens by moving the flexible lens center between adjacent-center and displaced-center configurations. In another embodiment, the collar member moves perpendicularly to the watch face to control the curvature of the flexible lens by moving the flexible lens outer edge between displaced-edge and adjacent-edge configurations.

16 Claims, 7 Drawing Sheets

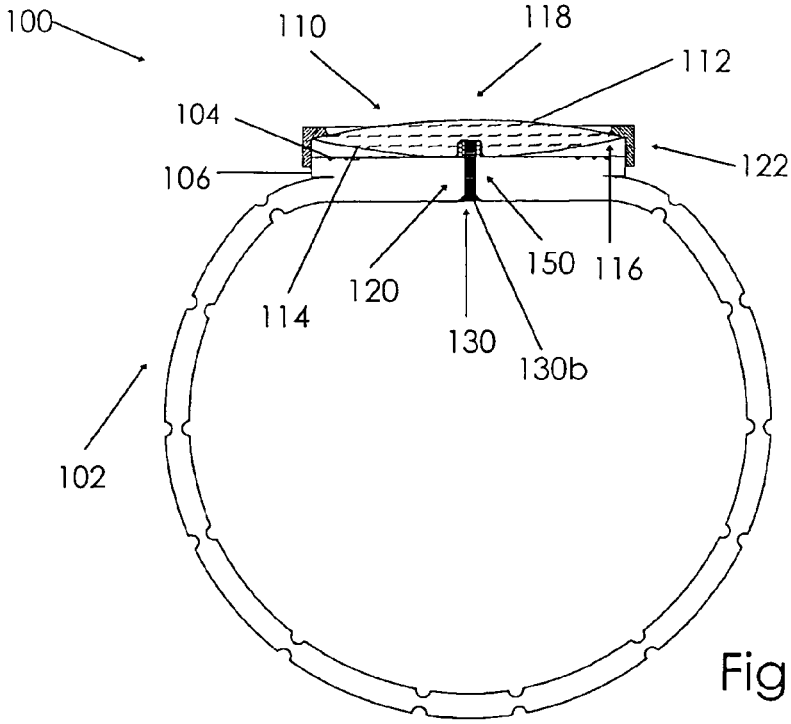
Fig. 2a
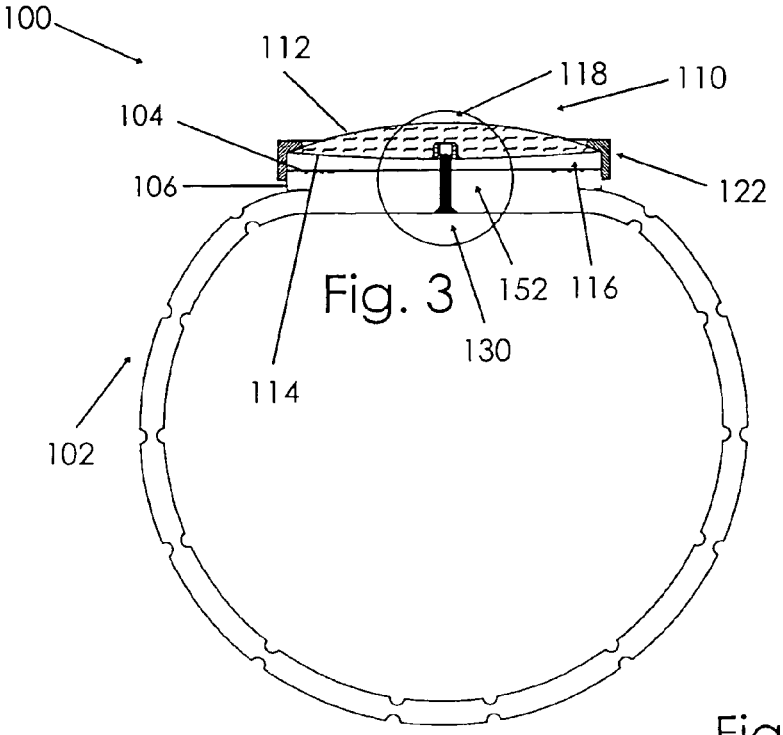
Fig. 3
Fig. 2b

ADJUSTABLE WATCH CRYSTAL APPARATUS

BACKGROUND OF THE INVENTION

This invention relates generally to a watch crystal. In particular, the present invention relates to an adjustable watch crystal apparatus.

Most people become farsighted with age, making it difficult for them to read an ordinary wristwatch without glasses. Today, most watches designed for visually impaired people are made with large faces and large numbering. Although effective, these watches are rarely attractive. Because wristwatches are often employed equally for function and style, unattractiveness is a significant shortcoming. A watch crystal that corrects farsightedness without an abnormally large face would overcome these issues and be greatly appreciated.

At the same time, however, it is important for people with varying degrees of farsightedness to be able to use the same watch. Otherwise, a customer would essentially have to get a prescription for his watch, which would provide only limited appeal.

Various proposals for magnifying watch crystals are found in the art. U.S. Pat. No. 5,566,137 discloses a fixed mirror and enlarging lens arrangement in which light is reflected internally and then bent before passing through the watch crystal. U.S. Pat. Nos. 5,883,860 and 6,275,333 disclose magnifying devices that are removably or pivotally attached to the outside of the watch crystal for magnifying the watch face. U.S. Pat. No. 6,406,769 discloses a watch crystal with a non-adjustable recess machined in the crystal's lower face for magnifying the watch face.

While assumably effective for their intended purposes, the existing devices do not provide a watch crystal that corrects varying degrees of farsightedness, adjusts easily, is stylish and attractive, is lightweight, utilizes optically clear polymers, and that can be incorporated into virtually any style of wristwatch. Therefore, it would be desirable to have a watch crystal having these features.

SUMMARY OF THE INVENTION

An adjustable watch crystal apparatus according to the present invention includes a watch body, a flexible lens having a changeable amount of curvature, and means for adjusting the amount of curvature of the flexible lens. The flexible lens is positioned upwardly adjacent a watch face for adjustably refracting light to make the watch face legible for a user with farsighted vision. The flexible lens includes top and bottom sides having convex configurations, an outer edge, and a center. The adjusting means includes a collar member attached to the watch body for retaining the outer edge of the flexible lens. In one embodiment of the current invention, an adjustment screw controls the curvature of the flexible lens by moving the flexible lens center between adjacent-center and displaced-center configurations. In another embodiment of the current invention, the collar member moves perpendicularly to the watch face to control the curvature of the flexible lens by moving the outer edge of the flexible lens between displaced-edge and adjacent-edge configurations. The adjustability of the watch crystal apparatus according to the present invention allows a single watch model to be used by multiple people with various levels of farsightedness and compensates for changes in an individual's vision over time.

Therefore, a general object of this invention is to provide an adjustable watch crystal apparatus that corrects varying degrees of farsightedness.

Another object of this invention is to provide an adjustable watch crystal apparatus, as aforesaid, that adjusts easily.

Still another object of this invention is to provide an adjustable watch crystal apparatus, as aforesaid, that is stylish and attractive.

Yet another object of this invention is to provide an adjustable watch crystal apparatus, as aforesaid, that is lightweight.

A further object of this invention is to provide an adjustable watch crystal apparatus, as aforesaid, that utilizes optically clear polymers.

A still further object of this invention is to provide an adjustable watch crystal apparatus, as aforesaid, that can be incorporated into virtually any style of wristwatch.

Other objects and advantages of this invention will become apparent from the following description taken in connection with the accompanying drawings, wherein is set forth by way of illustration and example, embodiments of this invention.

BRIEF DESCRIPTION OF THE DRAWINGS

FIG. 2*a* is a sectional view of the apparatus and watch taken along line 2*a*–2*a* of FIG. 1*b* with the flexible lens in an adjacent-center configuration;

FIG. 2*b* is a sectional view of the apparatus and watch taken along line 2*a*–2*a* of FIG. 1*b* with the flexible lens in a displaced-center configuration;

DESCRIPTION OF THE PREFERRED EMBODIMENT

Figure 1A:
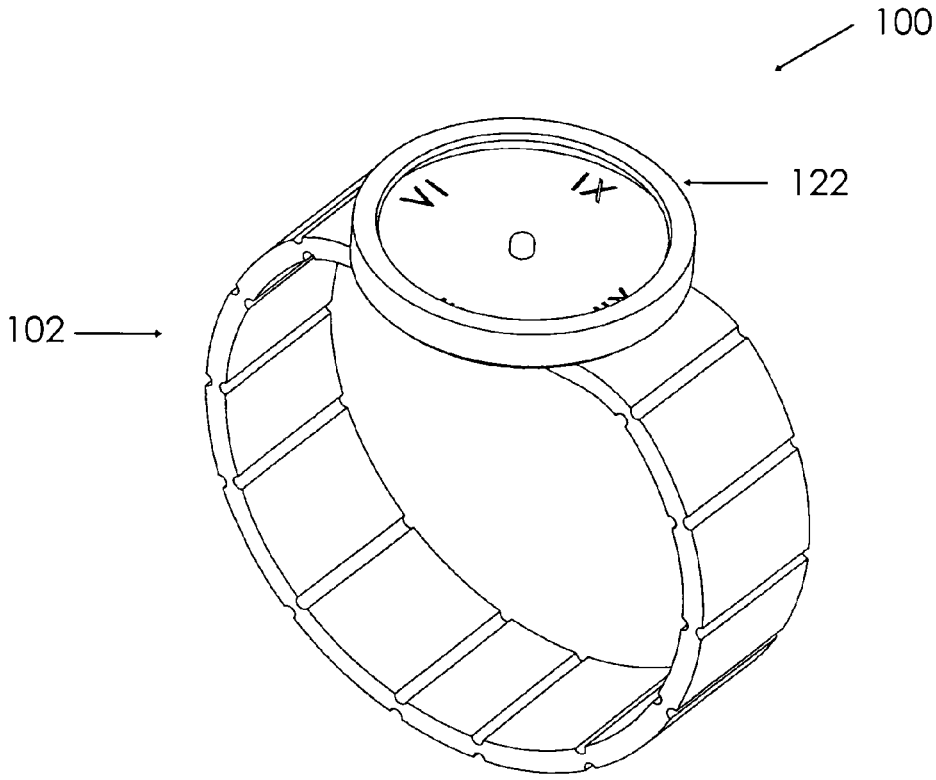
FIG. 1*a* is a perspective view of an adjustable watch crystal apparatus according to the present invention incorporated into a watch.
Figure 1B:
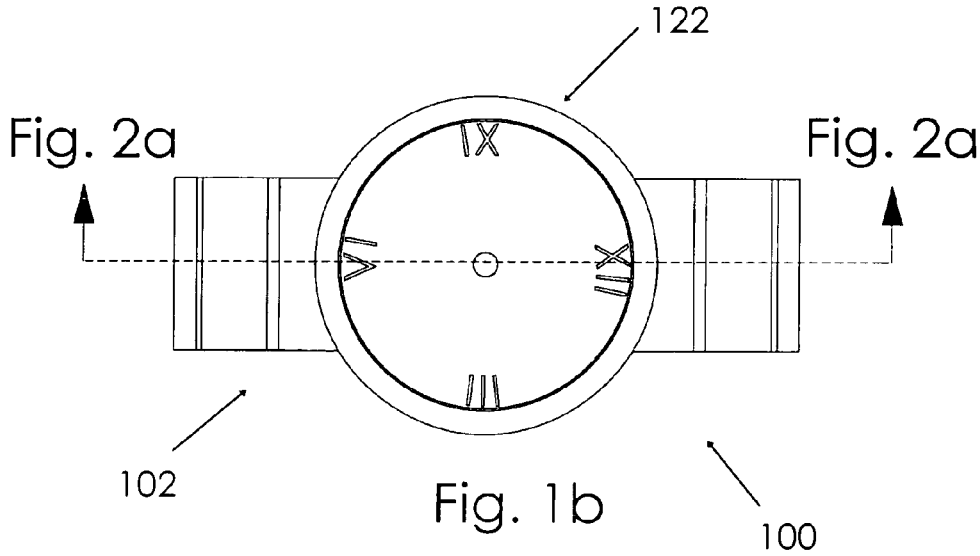
FIG. 1*b* is a top view of the apparatus as in FIG. 1*a* incorporated into a watch.

An adjustable watch crystal apparatus according to the present invention will now be described in detail with reference to FIGS. 1*a* through 4 of the accompanying drawings. More particularly, an adjustable watch crystal apparatus 100 for use in a watch 102 having a watch face 104 includes a watch body 106, a flexible lens 110 having a changeable amount of curvature, and means 120 for adjusting the amount of curvature of the flexible lens 110. "Watch" as used herein refers to a wristwatch as well as other timepieces, such as a wall clock or a pocket-watch.

The flexible lens 110 is positioned upwardly adjacent the watch face 104 for adjustably refracting light to make the watch face 104 legible for a user with farsighted vision (FIGS. 2*a* and 2*b*). The flexible lens 110 includes an outer edge 116 and a center 118 (also called an inner portion 118), and top and bottom sides 112, 114 having convex configurations. The flexible lens 110 may be configured to correspond to almost any regular or irregular shape taken by the watch face 104, including circular, rectangular, and triangular shapes. Though the flexible lens 110 is preferably constructed of an optically clear polymer, other suitable materials may be used.

Figure 3:
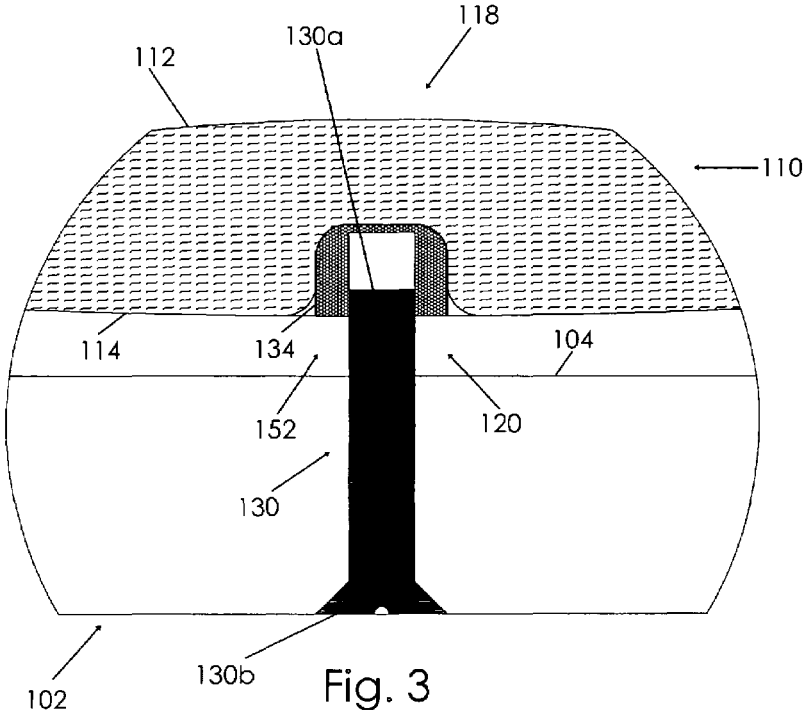
FIG. 3 is an enlarged view of the adjustment screw, threaded hub, and flexible lens taken from FIG. 2*b;*
Figure 4:
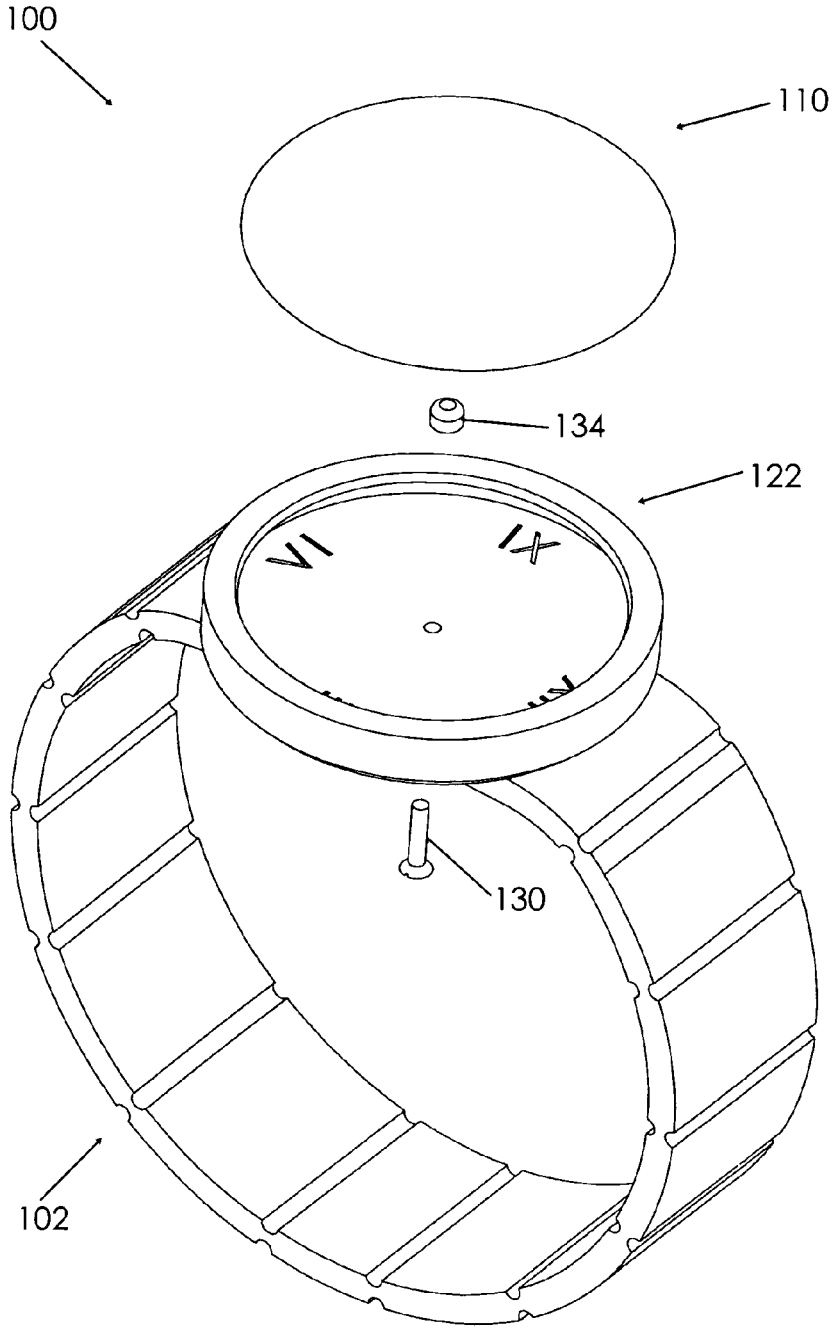
FIG. 4 is an exploded perspective view of the apparatus as in FIG. 1 with a watch.
Figure 6:
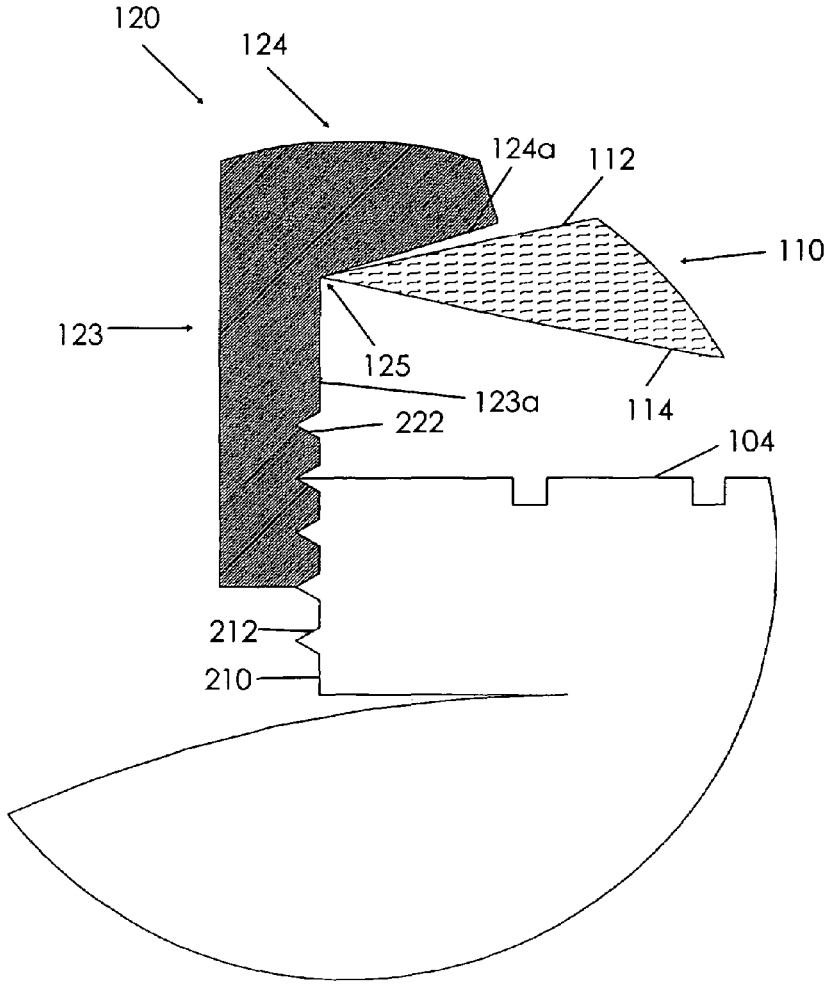
FIG. 6 is an enlarged view of the collar member, watch body, and flexible lens taken from FIG. 5*c*.

The means 120 for adjusting the curvature of the flexible lens 110 includes a collar member 122, an adjustment screw 130, and a threaded hub 134 (FIG. 2*a* through FIG. 3). The collar member 122 is attached to the watch body 106 and encompasses the flexible lens 110. The collar member 122 has an outer portion 123 that includes a generally vertical inner wall 123*a* and an upper portion 124 that includes a lower wall 124*a* (FIG. 6). The inner and lower walls 123*a*, 124*a* meet at an obtuse angle 125 for retaining the outer edge 116 of the flexible lens 110. The collar member 122 may be fixedly or rotatably attached to the watch body 106.

The adjustment screw 130 extends through the watch body 106 for axial rotation therein and has a free end 130*a* and an adjustment end 130*b* (FIG. 3). The free end 130*a* is operatively coupled to the center 118 of the flexible lens 110 for selectively moving the flexible lens center 118 between adjacent-center and displaced-center configurations 150, 152 relative to the watch face 104 (FIGS. 2*a* and 2*b*). The threaded hub 134 is positioned at the flexible lens center 118 for threadably engaging the free end 130*a* of the adjustment screw 130. The flexible lens center 118 is preferably biased toward the adjacent-center configuration 150, and the flexible lens center 118 may include internal threads (not shown) without including the threaded hub 134.

In use, the adjustment end 130*b* of the adjustment screw 130 is turned using a screwdriver or a similar tool. The turning of the adjustment end 130*b* causes the adjustment screw 130 to rotate within the watch body 106 and the free end 130*a* to operate the threaded hub 134, causing the threaded hub 134 to move generally perpendicularly to the watch face 104. The movement of the threaded hub 134 moves the flexible lens center 118 between the adjacent-center and displaced-center configurations 150, 152, thereby changing the curvature of the flexible lens 110. After the farsighted user appropriately adjusts the curvature of the flexible lens 110, he may view the watch face 104 without the aid of glasses or other corrective lenses. The curvature of the flexible lens 110 may then be readjusted as necessary to correspond with future changes in the user's vision. This adjustability allows a single watch model to be used by multiple people with various levels of farsightedness and compensates for changes in an individual's vision over time.

An adjustable watch crystal apparatus (not shown) according to another embodiment of the present invention includes a construction substantially similar to the construction previously described except as specifically noted below. More particularly, the adjustable watch crystal apparatus according to this embodiment does not include the threaded hub 134 or internal threads defined by the flexible lens center 118. The turning of the adjustment end 130*b* causes the adjustment screw 130 to rotate within the watch body 106 and the free end 130*a* to move generally perpendicularly to the watch face 104. As the free end 130*a* moves away from the watch face 104, the free end 130*a* pushes the flexible lens 110 toward the displaced-center configuration 152. As the free end 130*a* moves toward the watch face 104, the flexible lens 110 moves toward the adjacent-center configuration 150 because the flexible lens 110 is biased toward the adjacent-center configuration 150 as noted above. Movement of the flexible lens 110 between the adjacent-center and displaced-center configurations 150, 152 changes the curvature of the flexible lens 110 as described above.

Figure 5A:
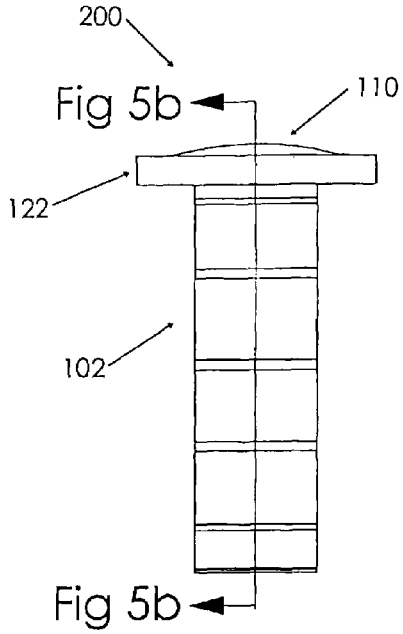
FIG. 5*a* is a side view of an adjustable watch crystal apparatus according to another embodiment of the present invention incorporated into a watch.
Figure 5B:
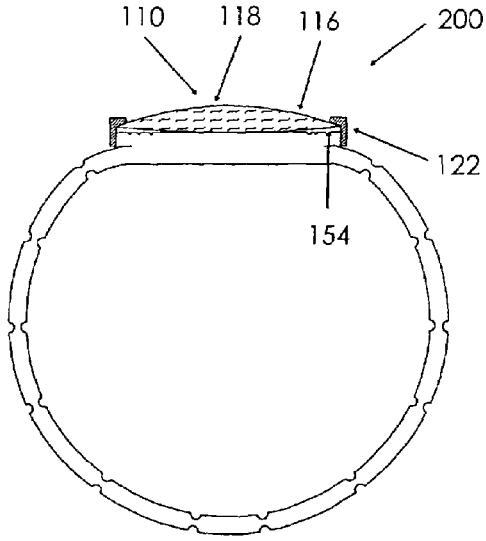
FIG. 5*b* is a sectional view of the apparatus and watch taken along line 5*b*–5*b* of FIG. 5*a* with the lens in an adjacent-edge configuration.
Figure 5C:
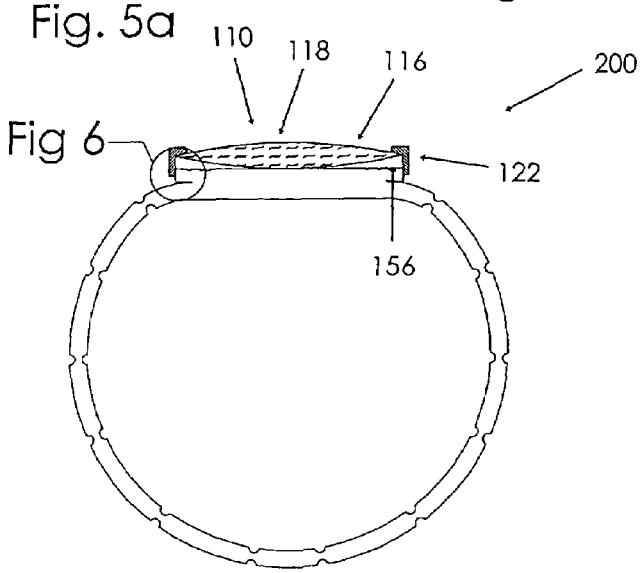
FIG. 5*c* is a sectional view of the apparatus and watch taken along line 5*b*–5*b* of FIG. 5*a* with the lens in a displaced-edge configuration.

An adjustable watch crystal apparatus 200 according to still another embodiment of the present invention is shown in FIGS. 5*a* through 6 and includes a construction substantially similar to the construction previously described except as specifically noted below. More particularly, the means 120 for adjusting the curvature of the flexible lens 110 includes the collar member 122 and threads 212 defined by an outer wall 210 of the watch body 106. The outer portion 123 of the collar member 122 defines internal threads 222 that are complementary to the watch body threads 212 for threadably attaching the collar member 122 to the watch body 106 (FIG. 6). The flexible lens 110 includes a generally circular configuration and has top and bottom sides 112, 114 having convex configurations.

In use, the collar member 122 is turned by hand, rotating the collar member 122 about the watch body outer wall 210. As the collar member 122 rotates, it moves generally perpendicularly to the watch face 104. The perpendicular movement of the collar member 122 moves the outer edge 116 of the flexible lens 110 between adjacent-edge and displaced-edge configurations 154, 156 (FIGS. 5*b* and 5*c*), which changes the curvature of the flexible lens 110. As the collar member 122 moves toward the watch face 104, the collar member 122 pushes the flexible lens 110 toward the adjacent-edge configuration 154. When the collar member 122 moves away from the watch face 104, the flexible lens 110 moves toward the displaced-edge configuration 156 because the flexible lens 110 is biased toward the displaced-edge configuration 156. The bias of the flexible lens 110 toward the displaced-edge configuration 156 corresponds to the bias of the flexible lens 110 toward the adjacent-center configuration 150.

Figure 7:
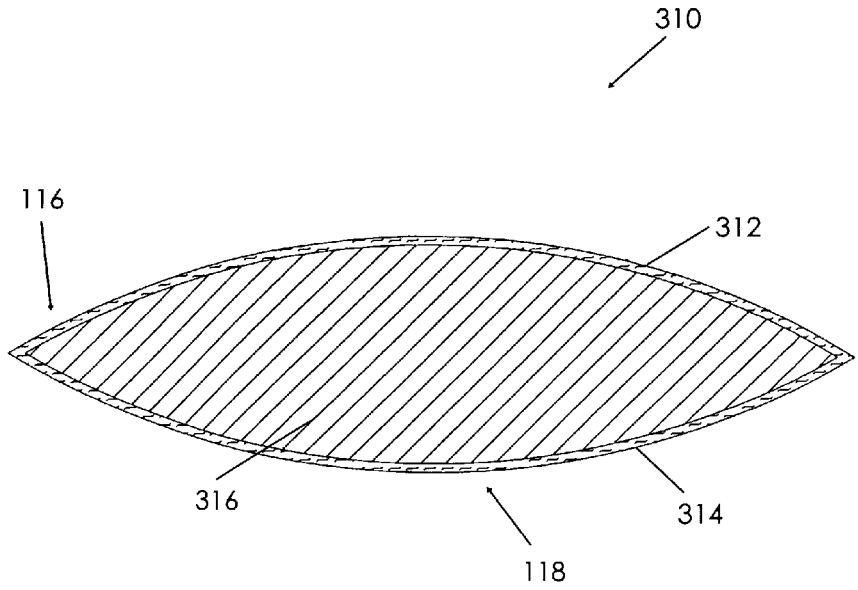
FIG. 7 is a sectional view of the flexible lens according to another embodiment of the present invention.

An adjustable watch crystal apparatus according to yet another embodiment of the present invention includes a construction substantially similar to the construction previously described except as specifically noted below. More particularly, the flexible lens 110 is a hollow shell 310 having top and bottom sides 312, 314 (FIG. 7). The top and bottom sides 312, 314 have convex configurations, and the hollow shell 310 is filled with a transparent fluid 316.

It is understood that while certain forms of this invention have been illustrated and described, it is not limited thereto except insofar as such limitations are included in the following claims and allowable functional equivalents thereof.

The invention claimed is:

1. An adjustable watch crystal apparatus for use in a watch having a watch face, comprising:

a watch body;

a flexible lens having a changeable amount of curvature, said flexible lens being positioned upwardly adjacent said watch face for adjustably refracting light to make said watch face legible for a user;

means for adjusting said amount of curvature of said flexible lens; and wherein said adjusting means includes a collar member attached to said watch body and encompassing said flexible lens, said collar member having an outer portion and an upper portion for retaining an outer edge of said flexible lens.

2. The apparatus as in claim 1, wherein said adjusting means includes an adjustment screw extending through said watch body for axial rotation therein, said adjustment screw having a free end operatively coupled to a center of said flexible lens for selectively moving said flexible lens center between adjacent and displaced configurations relative to said watch face, whereby adjustment of said adjustment screw changes said curvature of said flexible lens.

3. The apparatus as in claim 2, further comprising a threaded hub positioned at said center of said flexible lens for threadably engaging said free end of said adjustment screw for selectively moving said flexible lens center between said adjacent and displaced configurations.

4. The apparatus as in claim 2, wherein said collar member is fixedly attached to said watch body.

5. The apparatus as in claim 4, further comprising a threaded hub positioned at said center of said flexible lens for threadably engaging said free end of said adjustment screw for selectively moving said flexible lens center between said adjacent and displaced configurations.

6. The apparatus as in claim 2, wherein said flexible lens is constructed of an optically clear polymer.

7. The apparatus as in claim 2, wherein said flexible lens comprises a hollow shell having top and bottom sides, said top and bottom sides having convex configurations, said hollow shell being filled with a transparent fluid.

8. The apparatus as in claim 2, wherein said flexible lens includes top and bottom sides having convex configurations.

9. The apparatus as in claim 2, wherein said flexible lens center is biased toward said adjacent configuration.

10. The apparatus as in claim 1, wherein said adjusting means includes:

threads defined by an outer wall of said watch body; and internal threads defined by said outer portion of said collar member that are complementary to said watch body threads for threadably attaching said collar member to said watch body for selectively moving said collar member generally perpendicularly to sail watch face, whereby said perpendicular movement of said collar member moves said flexible lens outer edge between adjacent and displaced configurations relative to said watch face for changing said curvature of said flexible lens.

11. The apparatus as in claim 10, wherein:

said outer portion of said collar member includes a generally vertical inner wall;

said upper portion of said collar member includes a lower wall; and said inner and lower walls of said collar member meet at an obtuse angle for retaining said flexible lens.

12. The apparatus as in claim 11, wherein said flexible lens includes a generally circular configuration and has top and bottom sides having convex configurations.

13. The apparatus as in claim 10, wherein said flexible lens includes a generally circular configuration and has top and bottom sides having convex configurations.

14. The apparatus as in claim 10, wherein said flexible lens is constructed of an optically clear polymer.

15. The apparatus as in claim 10, wherein said flexible lens comprises a hollow shell having top and bottom sides, said top and bottom sides having convex configurations, said hollow shell being filled with a transparent fluid.

16. The apparatus as in claim 10, wherein said flexible lens outer edge is biased toward said displaced configuration.

* * * * *